US008922443B2

(12) United States Patent
Zhu et al.

(10) Patent No.: US 8,922,443 B2
(45) Date of Patent: Dec. 30, 2014

(54) DISTRIBUTED LOOP ANTENNA WITH MULTIPLE SUBLOOPS

(71) Applicant: Apple, Inc., Cupertino, CA (US)

(72) Inventors: Jiang Zhu, Sunnyvale, CA (US); Qingxiang Li, Mountain View, CA (US); Robert W. Schlub, Cupertino, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 163 days.

(21) Appl. No.: 13/629,005

(22) Filed: Sep. 27, 2012

(65) Prior Publication Data

US 2014/0085161 A1 Mar. 27, 2014

(51) Int. Cl.
*H01Q 11/12* (2006.01)

(52) U.S. Cl.
USPC ..... 343/741; 343/702; 343/866; 343/867

(58) Field of Classification Search
CPC ..... H01Q 21/00; H01Q 7/00
USPC ..... 343/741, 742, 788, 866, 867, 702
See application file for complete search history.

(56) References Cited

U.S. PATENT DOCUMENTS

| | | | | |
|---|---|---|---|---|
| 5,694,139 | A * | 12/1997 | Saito et al. | 343/866 |
| 5,877,728 | A | 3/1999 | Wu et al. | |
| 7,227,504 | B2 | 6/2007 | Deguchi et al. | |
| 7,315,290 | B2 * | 1/2008 | Harada et al. | 343/866 |
| 7,323,994 | B2 * | 1/2008 | Yamagajo et al. | 340/572.7 |
| 7,342,539 | B2 | 3/2008 | Rosenberg et al. | |
| 7,443,362 | B2 * | 10/2008 | Yungers | 343/895 |
| 7,446,729 | B2 | 11/2008 | Maruyama et al. | |
| 7,688,270 | B2 * | 3/2010 | Tsushima | 343/788 |
| 7,782,257 | B2 | 8/2010 | Kim et al. | |
| 7,821,463 | B2 * | 10/2010 | Nishikido et al. | 343/702 |
| 2007/0080889 | A1 | 4/2007 | Zhang | |
| 2010/0156741 | A1 | 6/2010 | Vazquez et al. | |
| 2012/0218695 | A1 | 8/2012 | Sakai | |
| 2012/0319912 | A1 * | 12/2012 | Taguchi | 343/788 |

FOREIGN PATENT DOCUMENTS

| | | |
|---|---|---|
| WO | 2011076582 | 6/2011 |
| WO | 2012049473 | 4/2012 |

OTHER PUBLICATIONS

Zhu et al., U.S. Appl. No. 13/299,123, filed Nov. 17, 2011.
Zhu et al., U.S. Appl. No. 13/216,073, filed Aug. 23, 2011.
Zhu et al., U.S. Appl. No. 13/629,061, filed Sep. 27, 2012.

* cited by examiner

*Primary Examiner* — Tho G Phan
(74) *Attorney, Agent, or Firm* — Treyz Law Group; G. Victor Treyz; Michael H. Lyons

(57) ABSTRACT

An electronic device may be provided with antenna structures. The antenna structures may be formed using a dielectric carrier structure. The antenna structures may have first and second loop antenna resonating elements. The first loop antenna resonating element may indirectly feed the second loop antenna resonating element. The second loop antenna resonating element may be a distributed loop element formed from multiple antenna resonating element subloops. The second loop antenna resonating element may be formed from a strip of metal with a width that loops around the dielectric carrier. An opening in the metal may separate first and second subloop antenna resonating elements from each other in the second loop antenna resonating element. Openings in the metal may form metal segments that collectively form an inductance for the first subloop. Antenna currents may flow through metal traces on the carrier and portions of an electronic device housing wall.

21 Claims, 12 Drawing Sheets

DISTRIBUTED LOOP ANTENNA WITH MULTIPLE SUBLOOPS

BACKGROUND

This relates generally to electronic devices and, more particularly, to electronic devices with antennas.

Electronic devices are often provided with antennas. Challenges can arise in mounting antennas within an electronic device. For example, factors such as the relative position between an antenna and surrounding device structures and electrical components and factors such as the size and shape of antenna structures can have an impact on antenna tuning and bandwidth. If care is not taken, an antenna may become detuned or may exhibit an undesirably small efficiency bandwidth at desired operating frequencies.

It would therefore be desirable to be able to provide improved antennas for use in electronic devices.

SUMMARY

An electronic device may be provided with antenna structures. The antenna structures may be formed using a dielectric carrier structure. The dielectric carrier may have an elongated shape that extends along a longitudinal axis. The longitudinal axis of the dielectric carrier may run parallel to an edge of the electronic device.

The antenna structures may have first and second loop antenna resonating elements. The first loop antenna resonating element may indirectly feed the second loop antenna resonating element. The second loop antenna resonating element may be a distributed loop element formed from multiple antenna resonating element subloops.

The antenna resonating element subloops may include a first antenna resonating element subloop that extends around the longitudinal axis and that surrounds at least some of the dielectric carrier structure and may include a second antenna resonating element subloop that extends around the longitudinal axis in parallel with the first subloop and that surrounds at least some of the dielectric carrier structure.

The second loop antenna resonating element may be formed from a strip of metal with a width that loops around the dielectric carrier. An opening in the metal may separate the first and second subloop antenna resonating elements from each other by helping to divide antenna currents between the first and second subloops. Openings in the metal may form metal segments that collectively form an inductance for the first subloop. Inductances formed from parallel metal segments may also be formed in other subloops. Antenna currents may flow through metal traces on the carrier and portions of an electronic device housing wall.

Further features of the invention, its nature and various advantages will be more apparent from the accompanying drawings and the following detailed description of the preferred embodiments.

DETAILED DESCRIPTION

Electronic devices may include antennas. The antennas may be used to transmit and receive wireless signals. Illustrative electronic devices that may be provided with antennas are shown in FIGS. 1, 2, 3, and 4.

Figure 1:
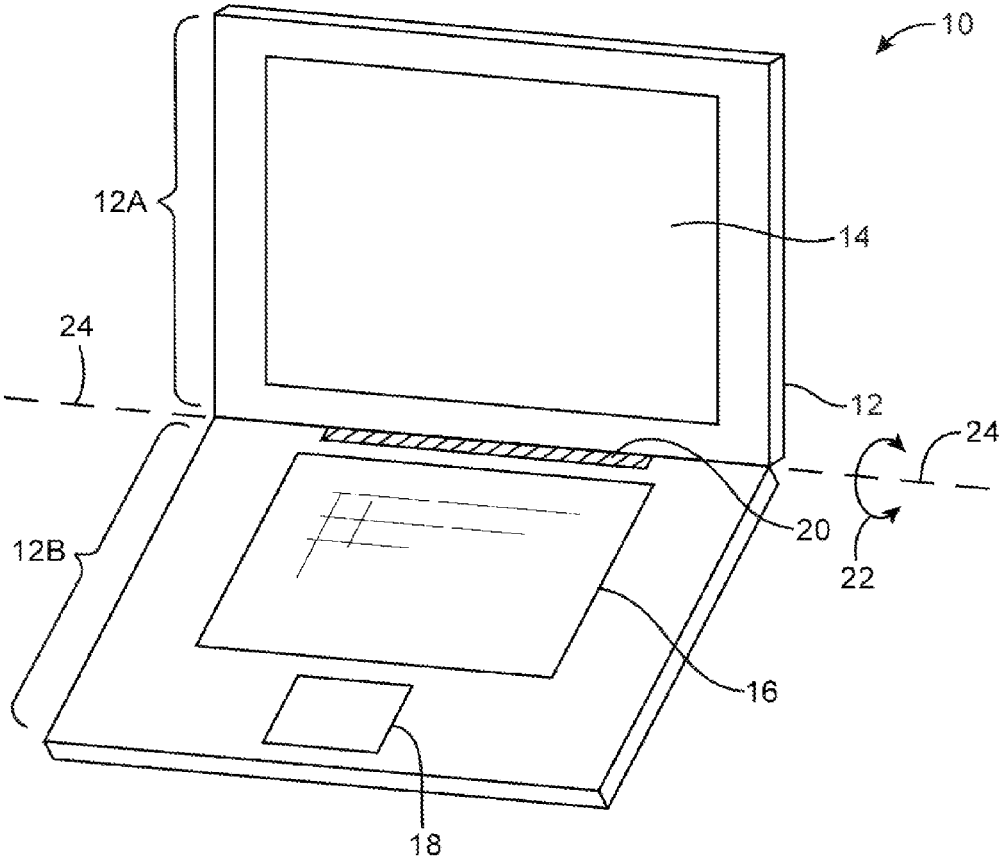
FIG. 1 is a perspective view of an illustrative electronic device such as a laptop computer that may be provided with antenna structures in accordance with an embodiment of the present invention.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24. Antenna structures may be mounted along the upper edge of upper housing 12A under a display cover layer associated with display 14 or elsewhere in device 10.

Figure 2:
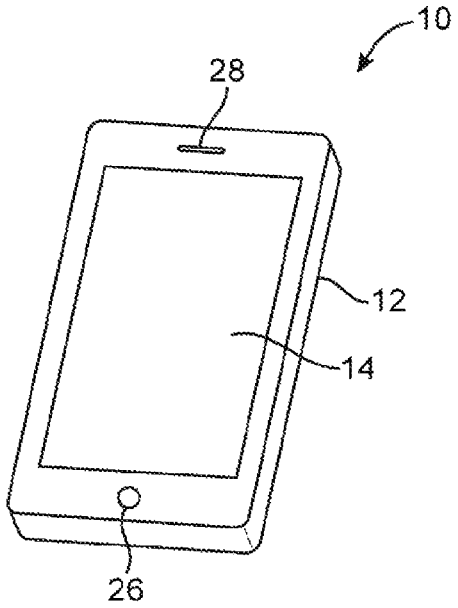
FIG. 2 is a perspective view of an illustrative electronic device such as a handheld electronic device that may be provided with antenna structures in accordance with an embodiment of the present invention.

FIG. 2 shows how electronic device 10 may be a handheld device such as a cellular telephone, music player, gaming device, navigation unit, or other compact device. In this type of configuration for device 10, housing 12 may have opposing front and rear surfaces. Display 14 may be mounted on a front face of housing 12. Display 14 may, if desired, have a display cover layer or other exterior layer that includes openings for components such as button 26. Openings may also be formed in a display cover layer or other display layer to accommodate a speaker port (see, e.g., speaker port 28 of FIG. 2). Antenna structures may be mounted under an inactive peripheral portion of the display cover layer for display 14 or elsewhere in housing 12 of FIG. 2.

Figure 3:
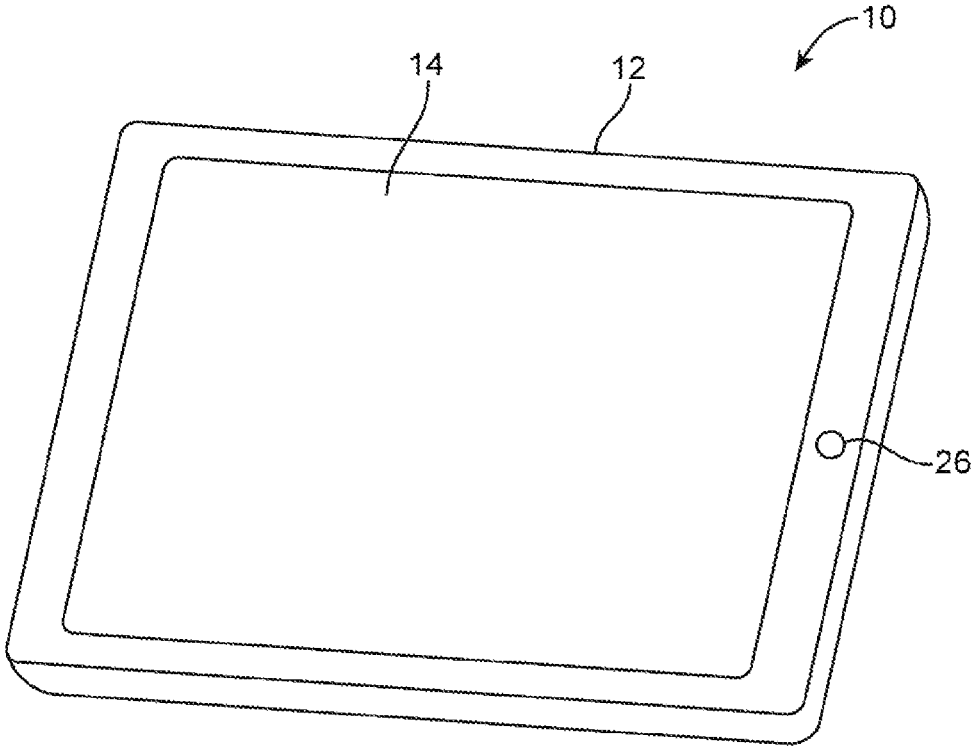
FIG. 3 is a perspective view of an illustrative electronic device such as a tablet computer that may be provided with antenna structures in accordance with an embodiment of the present invention.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have a display cover layer or other external layer with an opening to accommodate button 26 (as an example). Antenna structures may be mounted under one of the peripheral edges of the display cover layer or elsewhere within device 10.

Figure 4:
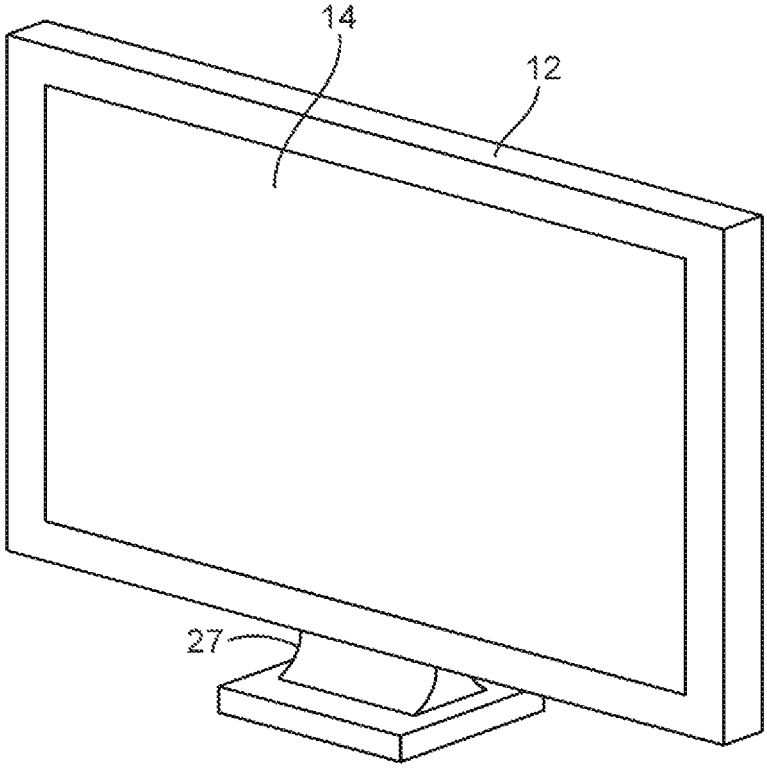
FIG. 4 is a perspective view of an illustrative electronic device such as a computer display with an integrated computer that may be provided with antenna structures in accordance with an embodiment of the present invention.

FIG. 4 shows how electronic device 10 may be a computer display or a computer that has been integrated into a computer display. With this type of arrangement, housing 12 for device 10 may be mounted on a support structure such as stand 27. Display 14 may be mounted on a front face of housing 12. Display 14 may, if desired, have a display cover layer. Antenna structures for device 10 of FIG. 4 may be mounted under one or more of the peripheral edges of the display cover layer or elsewhere within device 10.

The illustrative configurations for device 10 that are shown in FIGS. 1, 2, 3, and 4 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures). In configurations in which housing 12 is formed from metal or other conductive materials, dielectric structures such as plastic structures may be used to form antenna windows that overlap some or all of the antenna structures in device 10. Antenna structures in device 10 may also be configured to transmit and receive radio-frequency antenna signals through display cover layers and other dielectric structures in device 10.

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Displays for device 10 may, in general, include image pixels formed from light-emitting diodes (LEDs), organic LEDs (OLEDs), plasma cells, electrowetting pixels, electrophoretic pixels, liquid crystal display (LCD) components, or other suitable image pixel structures.

A display cover layer may cover the surface of display 14 or a display layer such as a color filter layer or other portion of a display may be used as the outermost (or nearly outermost) layer in display 14. A display cover layer or other outer display layer may be formed from a transparent glass sheet, a clear plastic layer, or other transparent member.

Touch sensor components such as an array of capacitive touch sensor electrodes formed from transparent materials such as indium tin oxide may be formed on the underside of a display cover layer, may be formed on a separate display layer such as a glass or polymer touch sensor substrate, or may be integrated into other display layers (e.g., substrate layers such as a thin-film transistor layer).

Figure 5:
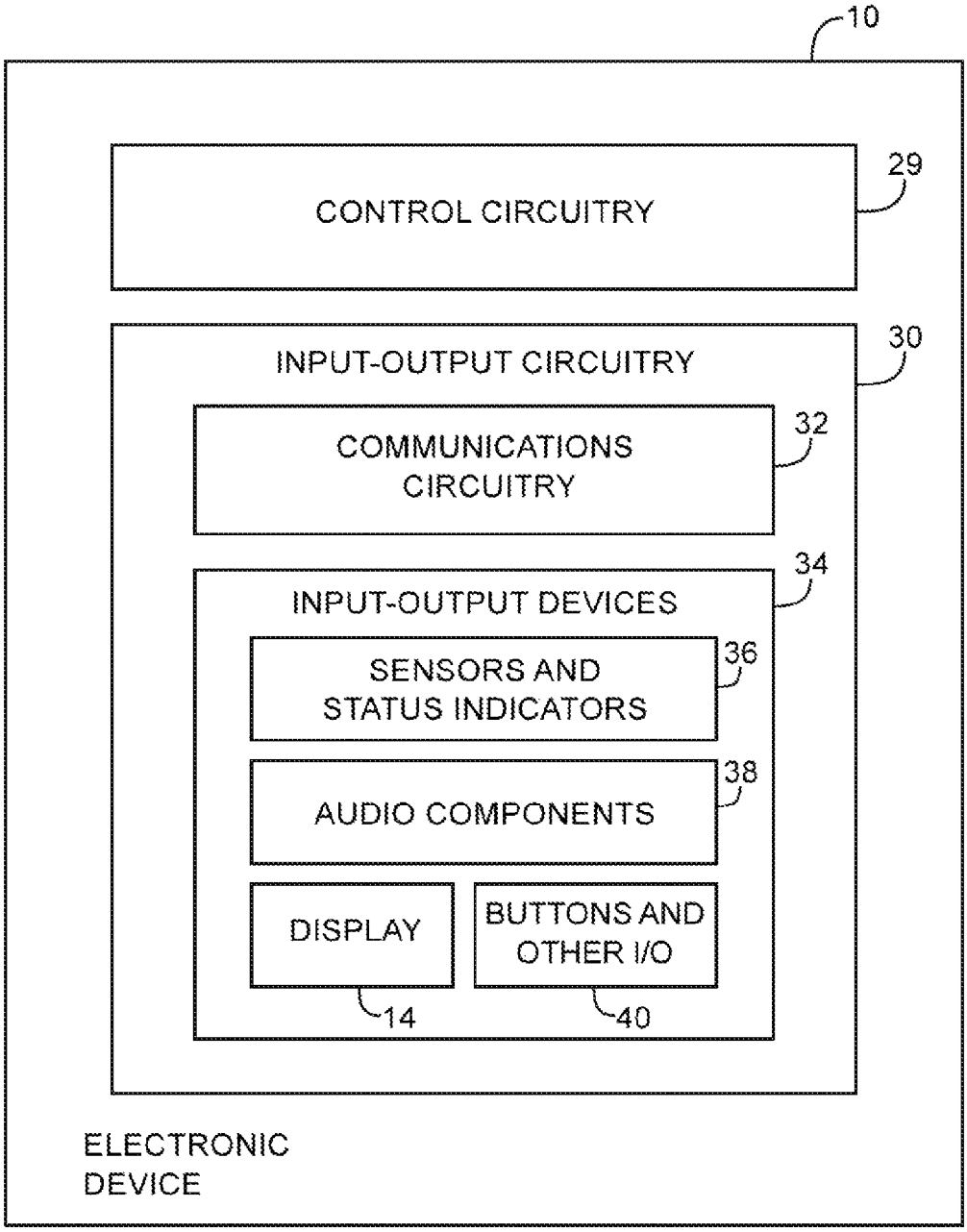
FIG. 5 is a schematic diagram of an illustrative electronic device with antenna structures in accordance with an embodiment of the present invention.

A schematic diagram of an illustrative configuration that may be used for electronic device 10 is shown in FIG. 5. As shown in FIG. 5, electronic device 10 may include control circuitry 29. Control circuitry 29 may include storage and processing circuitry for controlling the operation of device 10. Control circuitry 29 may, for example, include storage such as hard disk drive storage, nonvolatile memory (e.g., flash memory or other electrically-programmable-read-only memory configured to form a solid state drive), volatile memory (e.g., static or dynamic random-access-memory), etc. Control circuitry 29 may include processing circuitry based on one or more microprocessors, microcontrollers, digital signal processors, baseband processors, power management units, audio codec chips, application specific integrated circuits, etc.

Control circuitry 29 may be used to run software on device 10, such as operating system software and application software. Using this software, control circuitry 29 may present audio information to the user of device 10 using speakers and other audio circuitry, may use antenna structures and radio-frequency transceiver circuitry to transmit and receive wireless signals, and may otherwise control the operation of device 10.

Input-output circuitry 30 may be used to allow data to be supplied to device 10 and to allow data to be provided from device 10 to external devices. Input-output circuitry 30 may include communications circuitry 32. Communications circuitry 32 may include wired communications circuitry for supporting communications using data ports in device 10. Communications circuitry 32 may also include wireless communications circuits (e.g., circuitry for transmitting and receiving wireless radio-frequency signals using antennas).

Input-output circuitry 30 may also include input-output devices 34. A user can control the operation of device 10 by supplying commands through input-output devices 34 and may receive status information and other output from device 10 using the output resources of input-output devices 34.

Input-output devices 34 may include sensors and status indicators 36 such as an ambient light sensor, a proximity sensor, a temperature sensor, a pressure sensor, a magnetic sensor, an accelerometer, and light-emitting diodes and other components for gathering information about the environment in which device 10 is operating and providing information to a user of device 10 about the status of device 10.

Audio components 38 may include speakers and tone generators for presenting sound to a user of device 10 and microphones for gathering user audio input.

Display 14 may be used to present images for a user such as text, video, and still images. Sensors 36 may include a touch sensor array that is formed as one of the layers in display 14.

User input may be gathered using buttons and other input-output components 40 such as touch pad sensors, buttons, joysticks, click wheels, scrolling wheels, touch sensors such as sensors 36 in display 14, key pads, keyboards, vibrators, cameras, and other input-output components.

Figure 6:
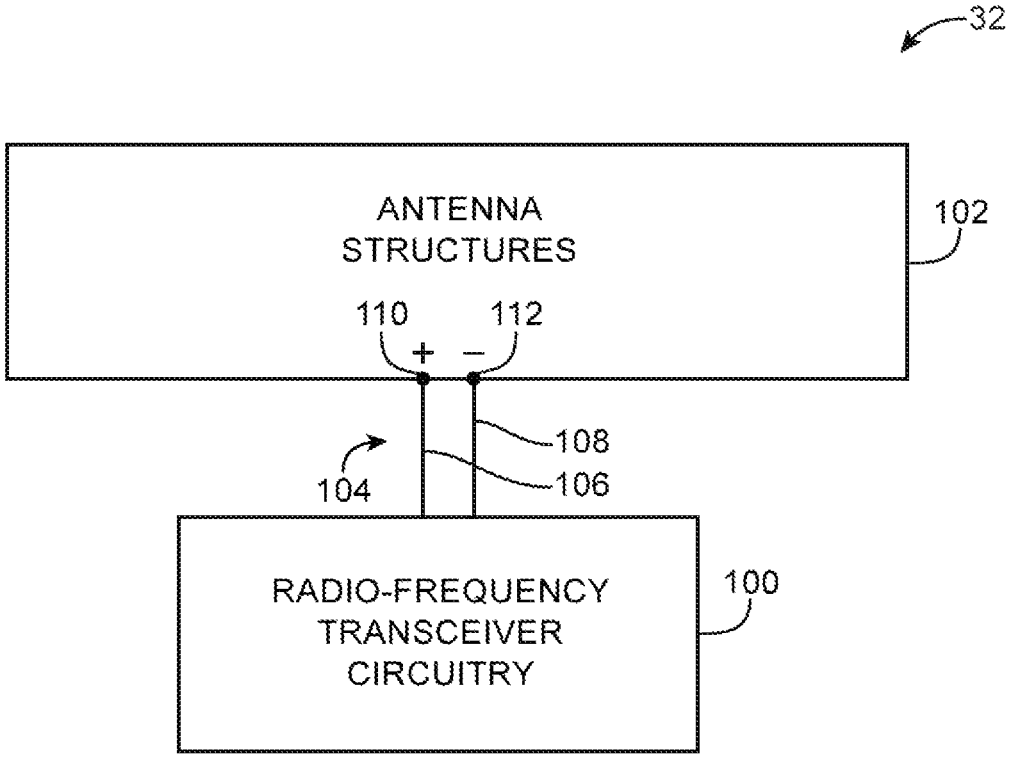
FIG. 6 is a schematic diagram of radio-frequency transceiver circuitry and antenna structures in accordance with an embodiment of the present invention.

As shown in FIG. 6, communications circuitry 32 may include wireless communications circuitry such as radio-frequency transceiver circuitry 100 and antenna structures 102. Communications circuitry 32 may include wireless circuitry formed from one or more integrated circuits, power amplifier circuitry, low-noise input amplifiers, passive radio-frequency components, one or more antennas such as antenna structures 102, and other circuitry for handling radio-frequency wireless signals.

Communications circuitry 32 may include radio-frequency transceiver circuits for handling multiple radio-frequency communications bands. For example, transceiver circuitry 100 may include circuits for handling cellular telephone communications, wireless local area network signals, and satellite navigation system signals such as signals at 1575 MHz from satellites associated with the Global Positioning System. Transceiver circuitry 100 may handle 2.4 GHz and 5 GHz bands for WiFi® (IEEE 802.11) communications and may handle the 2.4 GHz Bluetooth® communications band. Circuitry 100 may include cellular telephone transceiver circuitry for handling wireless communications in cellular telephone bands such as the bands in the range of 700 MHz to 2.7 GHz (as examples).

Communications circuitry 32 can include wireless circuitry for other short-range and long-range wireless links if desired. For example, circuitry 32 may include wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Communications circuitry 32 may include antenna structures 102. Antenna structures 102 may include one or more antennas. Antenna structures 102 may include inverted-F antennas, patch antennas, loop antennas, monopoles, dipoles, single-band antennas, dual-band antennas, antennas that cover more than two bands, or other suitable antennas. Configurations in which at least one antenna in device 10 is formed using loop antenna structures are sometimes described herein as an example.

To provide antenna structures 102 with the ability to cover communications frequencies of interest, antenna structures 102 may, if desired, be provided with tunable circuitry that is controlled by control circuitry 29. For example, control circuitry 29 may supply control signals to tunable circuitry in antenna structures 102 during operation of device 10 whenever it is desired to tune antenna structures 102 to cover a desired communications band.

Transceiver circuitry 100 may be coupled to antenna structures 102 by signal paths such as signal path 104. Signal path 104 may include one or more transmission lines. As an example, signal path 104 of FIG. 6 may be a transmission line having a positive signal conductor such as line 106 and a ground signal conductor such as line 108. Lines 106 and 108 may form parts of a coaxial cable or a microstrip transmission line having an impedance of 50 ohms (as an example). A matching network formed from components such as inductors, resistors, and capacitors may be used in matching the impedance of antenna structures 102 to the impedance of transmission line 104. Matching network components may be provided as discrete components (e.g., surface mount technology components) or may be formed from housing structures, printed circuit board structures, traces on plastic supports, etc.

Transmission line 104 may be coupled to antenna feed structures associated with antenna structures 102. As an example, antenna structures 102 may form an antenna having an antenna feed with a positive antenna feed terminal such as terminal 110 and a ground antenna feed terminal such as ground antenna feed terminal 112. Positive transmission line conductor 106 may be coupled to positive antenna feed terminal 110 and ground transmission line conductor 108 may be coupled to ground antenna feed terminal 112. Other types of antenna feed arrangements may be used if desired. The illustrative feed configuration of FIG. 6 is merely illustrative.

Antenna structures 102 may be formed from metal traces or other patterned conductive material supported by a dielectric carrier. With one suitable arrangement, antenna structures 102 may be based on loop antenna structures. For example, antenna structures 102 may include a strip of conductive material that is wrapped into a loop. Because the strip of conductive material has an associated width across which material is distributed, loop antenna structures such as these may sometimes be referred to as distributed loop antenna structures. A distributed loop antenna may be fed using a direct feeding arrangement in which feed terminals such as terminals 110 and 112 are coupled directly to the strip of material that forms the loop, may be fed indirectly by using near-field electromagnetic coupling to couple a loop antenna feeding element or other element to the loop that is formed from the strip of material, or may be fed using other suitable feed arrangements.

Figure 7:
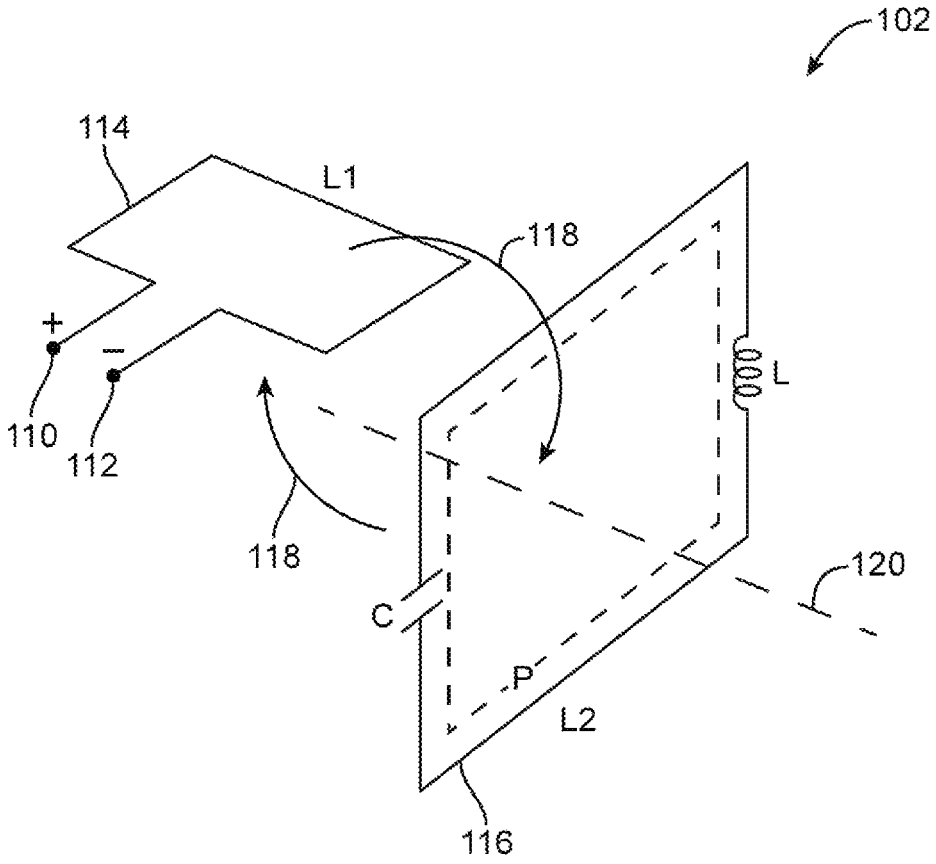
FIG. 7 is a diagram of illustrative loop antenna structures in accordance with an embodiment of the present invention.

A schematic diagram of a distributed loop antenna of the type that may be used in electronic devices 10 of FIGS. 1, 2, 3, and 4 is shown in FIG. 7. As shown in FIG. 7, distributed loop antenna structures 102 (sometimes referred to as distributed loop antenna 102) may include a first loop antenna resonating element L1 that is formed from a loop of conductor such as conductor 114 and a second loop antenna resonating element L2 (a distributed loop element) that is formed from a loop of conductor such as conductor 116.

As shown in FIG. 7, loop antenna resonating element L2 may be indirectly fed using loop-shaped antenna resonating element L1, which serves as an indirect antenna feeding structure. As illustrated by electromagnetic fields 118 of FIG. 7, antenna element (feed structure) L1 and loop-shaped antenna resonating element L2 may be coupled using near-field electromagnetic coupling.

Antenna structures 102 of FIG. 7 may be coupled to radio-frequency transceiver circuitry 100 (FIG. 6) using transmission line 104. For example, positive transmission line conductor 106 may be coupled to positive antenna feed terminal 110 and ground transmission line conductor 108 may be coupled to ground antenna feed terminal 112.

In the illustrative configuration of FIG. 7 in which the conductive lines of transmission line 104 are coupled to the feed terminals 110 and 112 of antenna element L1, antenna resonating element L2 may be indirectly fed. If desired, antenna resonating element L2 may be directly fed by coupling transmission line 104 across pairs of terminals in element L2. Indirect feeding arrangements for loop antenna structures 102 may sometimes be described herein as an example. This is, however, merely illustrative. In general, any suitable feeding arrangement may be used for feeding antenna 102 if desired.

Loop antenna structures 102 may be formed using conductive antenna resonating element structures such as metal traces on a dielectric carrier. The dielectric carrier may be formed from glass, ceramic, plastic, or other dielectric material. As an example, the dielectric carrier may be formed from a plastic support structure. The plastic support structure may, if desired, be formed from a hollow speaker box enclosure that serves as a resonant cavity for a speaker driver.

The conductive structures that form loop antenna structures 102 may include wires, metal foil, conductive traces on printed circuit boards, portions of conductive housing structures such as conductive housing walls and conductive internal frame structures, and other conductive structures.

As shown in FIG. 7, antenna resonating element L2 may have a longitudinal axis such as axis 120. Axis 120 may sometimes be referred to as the longitudinal axis of loop distributed loop antenna structures 102 and/or the longitudinal axis of a dielectric carrier used to support conductive loop structures. Loop antenna structures 102 may have resonating element conductive structures that are spread out ("distributed") along longitudinal axis 120 of loop L2.

Conductive structures 116 in resonating element loop L2 of antenna structures 102 may include a strip or sheet of conductor that has a first dimension that is wrapped around longitudinal axis 120 and a second dimension (i.e., a width W) that extends along the length of longitudinal axis 120. Conductive structures 116 may wrap around axis 120. During operation, antenna currents can flow within the strip-shaped conductive material of loop L2 around axis 120. In effect, conductive material 116 will form a wide strip of conductor in the shape of a loop that is characterized by a perimeter P. The antenna currents flowing in loop L2 tend to wrap around longitudinal axis 120. When installed within device 10, longitudinal axis 120 of antenna element L2 may extend parallel to an adjacent edge of housing 12 in electronic device 10 (as an example).

It may be desirable to form distributed loop antenna structures 102 from conductive structures that exhibit a relatively small dimension P. In a loop without any break along periphery P, the antenna may resonate at signal frequencies where the signal has a wavelength approximately equal to P. In compact structures with unbroken loop shapes, the frequency of the communications band covered by antenna loop L2 may therefore tend to be high. By incorporating a gap or other capacitance-generating structure into the loop, a capacitance C can be introduced into antenna loop L2. Conductive material 116 may also be configured to form one or more inductor-like paths to introduce inductance L into antenna loop L2. Material 116 may, for example, be configured to produce segments of conductive material 116 within loop L2 that serve as inductance-producing wires. With the presence of capacitance C and inductance L within the perimeter of loop antenna element L2, the resonant frequency of antenna element L2 may be reduced to a desired frequency of operation without enlarging the value of perimeter P.

Figure 8:
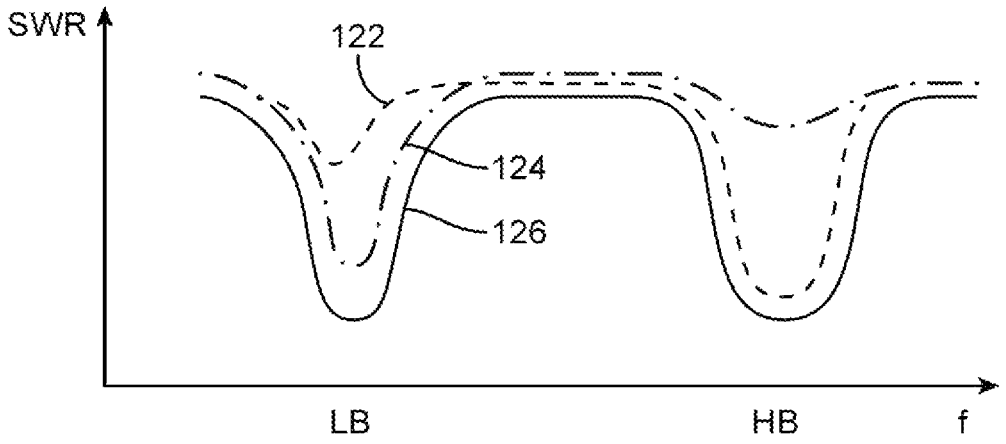
FIG. 8 is a graph of antenna performance as a function of operating frequency for an illustrative antenna of the type shown in FIG. 7 in accordance with an embodiment of the present invention.

FIG. 8 is a graph in which antenna performance (standing wave ratio) for antenna structures such as antenna structures 102 of FIG. 7 has been plotted as a function of operating frequency. In the example of FIG. 8, antenna structures 102 have been configured to resonate in a lower frequency band LB and a higher frequency band HB. Communications bands LB and HB may be cellular telephone bands, satellite navigation system bands, local area network bands, and/or other suitable communications bands. As an example, low band LB may be associated with a 2.4 GHz wireless local area network band and high band HB may be associated with a 5 GHz wireless local area network band (as an example).

Dashed curve 122 of FIG. 8 corresponds to the contribution of loop antenna resonating element L1 to the performance of antenna structures 102. Dashed-and-dotted curve 124 corresponds to the contribution of loop antenna resonating element L2 to the performance of antenna structures 102.

During operation, both elements L1 and L2 contribute to the overall performance of antenna structures 102 represented by curve 126. At lower frequencies such as frequencies in low band LB, antenna resonating element L2 serves at the primary radiating element in structures 102 and antenna resonating element L1 serves as a secondary radiating element in structures 102. At higher frequencies such as frequencies in high band HB, antenna resonating element L1 serves as the primary radiating element in antenna structures 102 and antenna resonating element L2 serves as a secondary radiating element.

To broaden the bandwidth of antenna structures, it may be desirable to form antenna resonating element L2 from multiple loop elements (i.e., loop L2 may be formed form multiple parallel subloops). In general, loop L2 may be formed form one antenna loop resonating element, two antenna loop resonating elements, three antenna loop resonating elements, or four antenna loop resonating elements. Illustrative configurations in which antenna structures 102 are formed from two parallel subloops may sometimes be described as an example.

Figure 9:
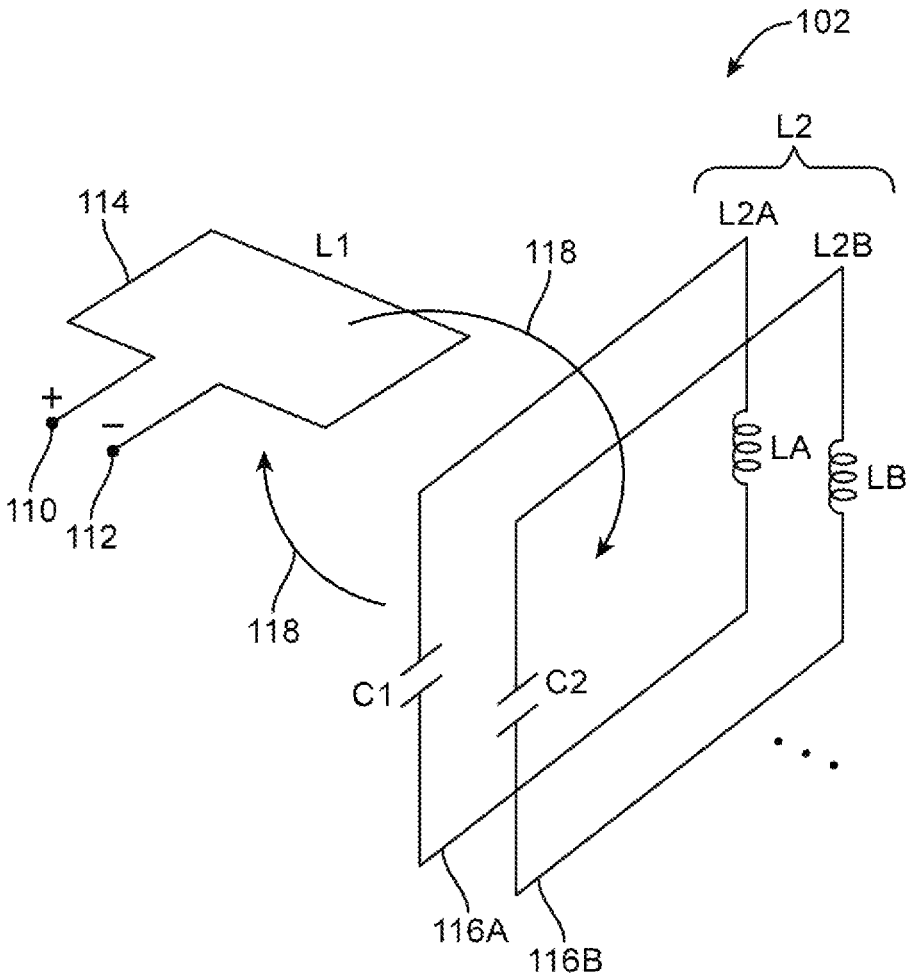
FIG. 9 is a diagram of an illustrative loop antenna having multiple parallel subloops in accordance with an embodiment of the present invention.

As shown in FIG. 9, antenna structures 102 may have a loop antenna resonating element L2 that is formed from subloops such as loop antenna resonating element L2A and loop antenna resonating element L2B. Subloops L2A and L2B may both be electromagnetically coupled to feed loop L1.

Loop L2A may include structures such as conductive structures 116A that form capacitance C1 and inductance LA. Loop L2B may include structures such as conductive structures 116B that form capacitance C2 and inductance LB. Capacitances C1 and C2 may be formed using discrete capacitors and/or using conductive antenna loop resonating element conductive structures to form gaps that give rise to capacitances C1 and C2. Inductances LA and LB may be formed using discrete inductors and/or using conductive antenna loop resonating element conductive structures to form current paths that give rise to inductances LA and LB. If desired, each subloop in loop L2 may include multiple capacitances and/or multiple inductances. The configuration of FIG. 9 in which each loop includes a capacitance and an inductance is merely illustrative.

Loops L2A and L2B may both extend around longitudinal axis 120. For example, the conductive materials of loop L2A may extend around axis 120 so that loop L2A surrounds at least part of a dielectric carrier, whereas the conductive materials of loop L2B may likewise extend around axis 120, running parallel with loop L2A and surrounding at least part of the dielectric carrier.

Figure 10:
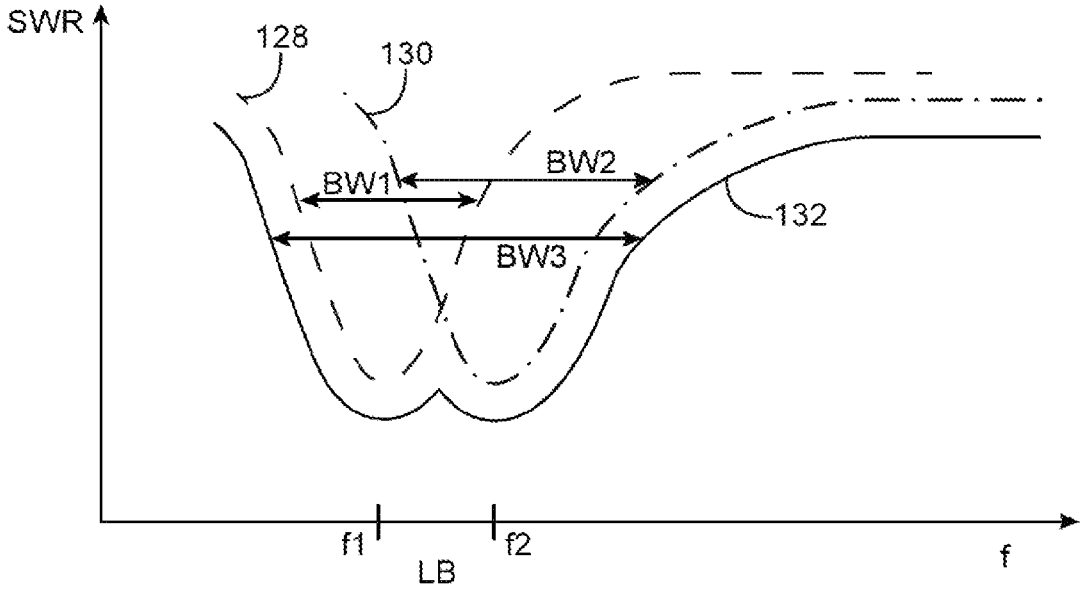
FIG. 10 is a graph of antenna performance as a function of operating frequency for an illustrative antenna of the type shown in FIG. 9 in accordance with an embodiment of the present invention.

By forming loop L2 from multiple parallel subloops such as loops L2A and L2B, the performance of antenna structures 102 may be enhanced. For example, the bandwidth of antenna structures 102 in one or more communications bands can be increased. FIG. 10 is a graph in which antenna performance (standing-wave ratio) has been plotted for antenna structures 102 of FIG. 9 in a communications band of interest (e.g., low band LB of FIG. 8). As described in connection with FIG. 8, antenna structures 102 may also resonate in other bands (e.g., high band HB).

As shown in FIG. 10, each subloop in loop L2 may contribute to a resonance at a potentially different frequency. For example, antenna resonating element loop L2A may be configured to exhibit a resonance at frequency f1, as illustrated by curve 128 in FIG. 10, whereas antenna resonating element loop L2 may be configured to exhibit a resonance at frequency f2, as illustrated by curve 130 in FIG. 10. By selecting locations of frequencies f1 and f2 so that the resonances at F1 and f2 overlap, the overall response curve for antenna structures 102 may be broadened, as illustrated by total response curve 132 of FIG. 10. In particular, loop L2A operating alone might exhibit a bandwidth of BW1 and loop L2B operating alone might exhibit a bandwidth of BW2. By configuring loops L2A and L2B so that frequencies f1 and f2 are adjacent but not equal, response curves 128 and 130 will overlap so that the resulting bandwidth BW3 of antenna structures 102 in low band LB is greater than BW1 and BW2. By using two or more subloops with different respective resonant frequencies in this way, the overall bandwidth of antenna structures 102 due to the contribution of antenna loop resonating element L2 may be enhanced.

Figure 11:
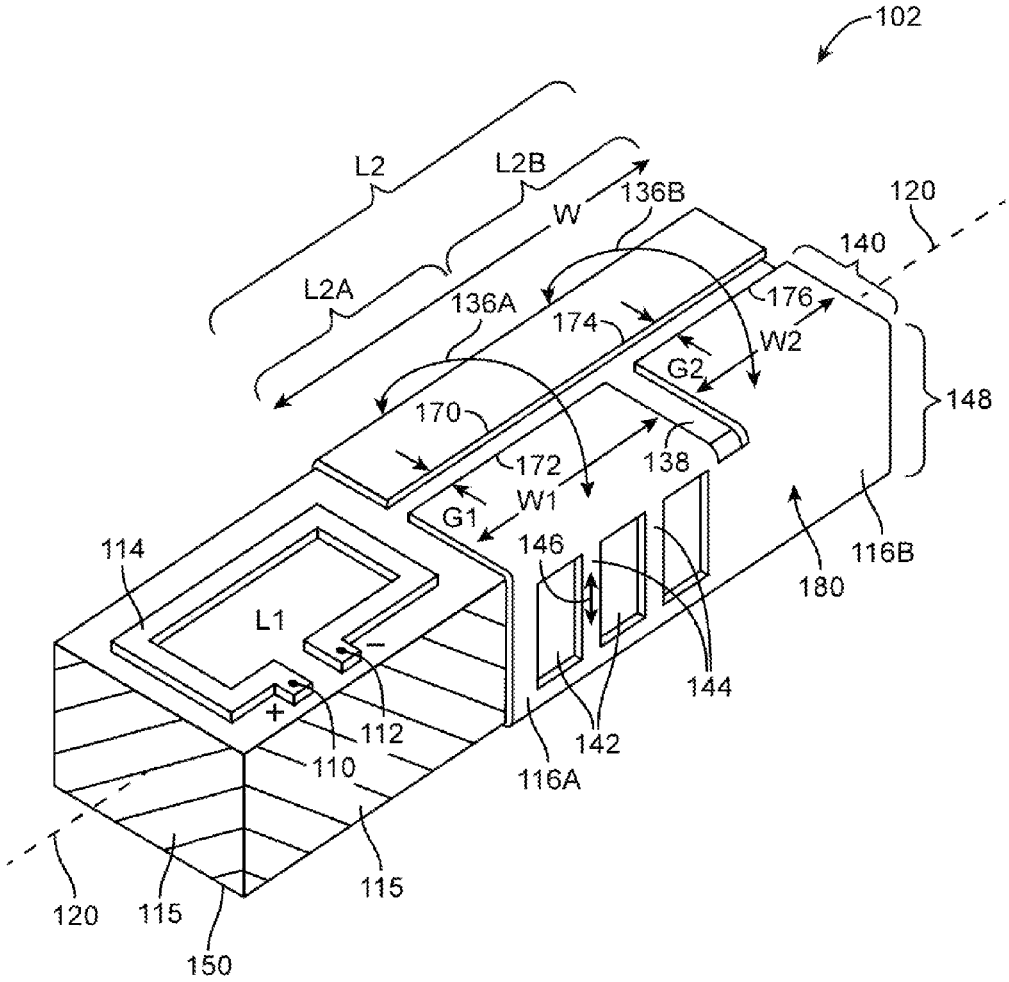
FIG. 11 is a perspective view of an illustrative distributed loop antenna formed using conductive traces on a dielectric antenna carrier in accordance with an embodiment of the present invention.

FIG. 11 is a perspective view of antenna structures 102 showing how conductive structures for antenna structures 102 may be formed on and around a speaker enclosure or other dielectric carrier 150. As shown in FIG. 11, antenna resonating element loop L1 may be formed from metal traces 114 on the upper surface of carrier 150. If desired, antenna resonating element loop traces 114 may be mounted in a ground cavity (i.e., loop L1 may be mounted in a cavity-backed antenna environment). For example, metal traces may be formed on the sidewalls of carrier 150 to the front, rear, side, and beneath traces 114 (see, e.g., cavity sidewalls 115 of FIG. 12). By placing traces 114 within antenna cavity 115, loop antenna resonating element can be decoupled from surrounding metal structures in device 10 (i.e., the performance of loop antenna L1 will not be affected by variations in the distance between carrier 150 and nearby conductive structures due to the isolation afforded by antenna cavity 115).

Antenna resonating element loop L2 may be formed from antenna resonating element loops such as parallel subloops L2A and L2B. Conductive structures such as metal traces on the surface of carrier 150 may extend around axis 120 to form loop L2. The metal of loop L2 may form a strip of width W.

An opening such as opening 138 may be formed in the metal of loop L2. For example, in a configuration in which the metal of loop L2 is formed from metal traces on the surface of carrier 150, a slot-shaped opening or other opening such as opening 138 may be formed by patterning the metal traces. The presence of opening 138 may at least partly divide the currents that flow in loop L2 into two parallel paths. Currents 136A may flow around axis 120 in conductive structures such as metal traces 116A, whereas currents 136B may tend to flow around axis 120 in in conductive structures such as metal traces 116B. Metal traces 116A may have the shape of a metal strip of width W1 that forms loop L2A. Metal traces 116B may have the shape of a metal strip of width W2 that forms loop L2B. If desired, other types of current dividing structures may be used (e.g., openings with shapes other than the rectangular slot shape of opening 138, openings with meandering paths, openings with curved edges, openings with combinations of curved and straight edges, multiple openings that are aligned in a line such as a series of slots or circular openings), etc. The shape of opening 138 that is shown in FIG. 11 is merely illustrative.

Metal traces 116A may be patterned to form capacitance C1 and inductance LA of FIG. 9. Metal traces 116B may be patterned to form capacitance C2 and inductance LB of FIG. 9. Capacitances such as capacitances C1 and C2 may be formed by creating gaps in the metal traces of loop L2. For example, a gap such as gap G1 may be formed between opposing edges 170 and 172 of traces 116A and a gap such as gap G2 may be formed between opposing edges 174 and 176 of traces 116B. Gap G1 may be characterized by capacitance C1. Gap G2 may be characterized by a capacitance C2. The values of C1 and C2 may be the same or may be different.

The layout of gaps such as gaps G1 and G2 may be configured to produce desired values for capacitances C1 and C2. If, for example, a large value of capacitance is desired in an antenna loop element, the edges of the gap in the loop element (e.g., edges 170 and 172 in loop L2A or edges 174 and 176 in loop L2B) may be placed closer together and/or the paths that the gap edges follow may be implemented using a meandering pattern that maximizes the lengths of the edges. If desired, one or both of gaps G1 and G2 and corresponding capacitances C1 and C2 may be omitted.

The conductive material of traces 116A and 116B may be configured to produce inductances such as inductances L1 and L2 of FIG. 9. For example, traces 116A may be provided with openings such as openings 142. As shown in FIG. 11, openings 142 may be slots or other openings of other elongated shapes that run parallel to each other. The shapes of openings 142 form metal segment structures between respective openings 142. In particular, the presence of openings 142 may give rise to narrow metal line segments such as segments 144 through which antenna currents 136A pass, as illustrated by current 146.

Segments 146 may be relatively long and thin and may therefore serve as inductive elements. Segments 146 may collectively produce inductance LA in loop L2A. Traces 116B may be provided with one or more openings such as openings 142 so as to increase the value of inductance LB in loop L2B or may, as shown in the example of FIG. 11, be provided with no openings so that portion 180 of traces 116B may form a single solid strip of metal characterized by a low or negligible value of inductance. In general, LA may be present and LB may be omitted, LB may be present and LA may be omitted, both LA and LB may be present using respective sets of parallel metal segments, or both LA and LB may be omitted.

Openings 142 in traces 116A of loop L2A may, if desired, overlap corresponding openings in carrier 150 (e.g., when carrier 150 is a hollow structure that is serving as a speaker box and when openings in carrier 150 are used to allow sound to exit the interior of the speaker box). Openings 142 may be formed on face 148 of carrier 150 or on other suitable carrier surfaces. Capacitor gaps G1 and G2 and current dividing openings such as opening 138 may be formed on upper surface 140 of carrier 150 (e.g., in a location that lies under a display cover glass or other dielectric rather than immediately under metal structures that could interfere with gaps G1 and G2 and opening 138) or may be formed on other carrier surfaces.

Figure 12:
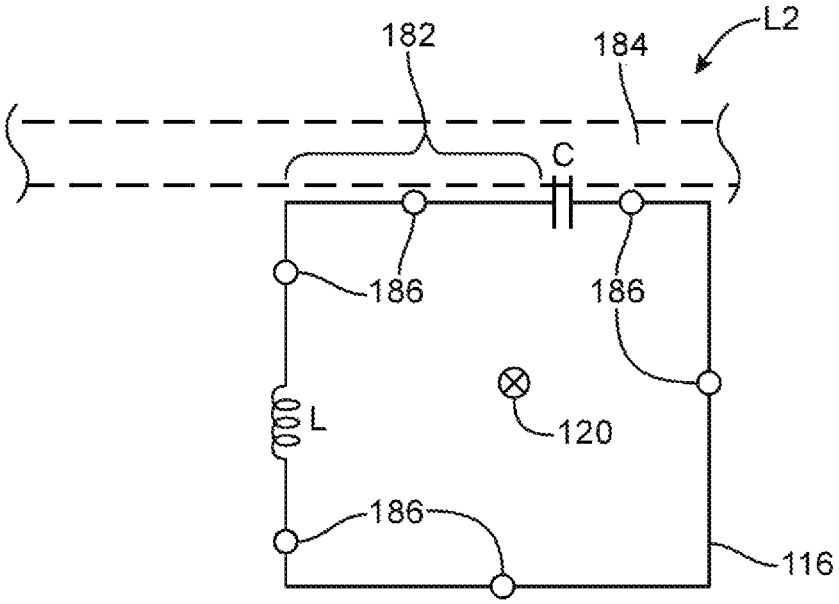
FIG. 12 is a diagram showing where a loop in a distributed loop antenna may be provided with current dividing structures to form multiple subloops in accordance with an embodiment of the present invention.

FIG. 12 is a schematic diagram of an antenna loop resonating element such as loop L2 showing how antenna loop resonating element L2 may be mounted in device 10 under dielectric layer 184. Dielectric layer 184 may be a display cover layer such as a layer of glass or plastic covering the face of display 14. The portion of layer 184 under which antenna loop resonating element L2 is mounted may correspond to an inactive region of display 14.

To provide adequate current separation between traces 116A and 116B and thereby effectively form loop antenna resonating elements L2A and L2B with distinct resonances as described in connection with FIG. 10 while ensuring that the current separator structures in loop L2 are not covered with metal structures that might interfere with their operation, it may be desirable to form current separator structures such as opening 138 in region 182 between capacitor C (i.e., C1 and C2) and inductance L (i.e., inductances L1 and L2) under dielectric layer 184.

If desired, loop L2 may be provided with one or more discrete components (e.g., capacitors or inductors packaged in surface mount technology packages, etc.). These components may be combined with switches or other circuits to form tunable components. Optional components 186 in loop L2 of FIG. 12 are interposed in loop L2 in illustrative locations where circuitry such as tunable circuitry, fixed circuitry, discrete inductors, discrete capacitors, and/or switches or other electronic devices may optionally be used.

Figure 13:
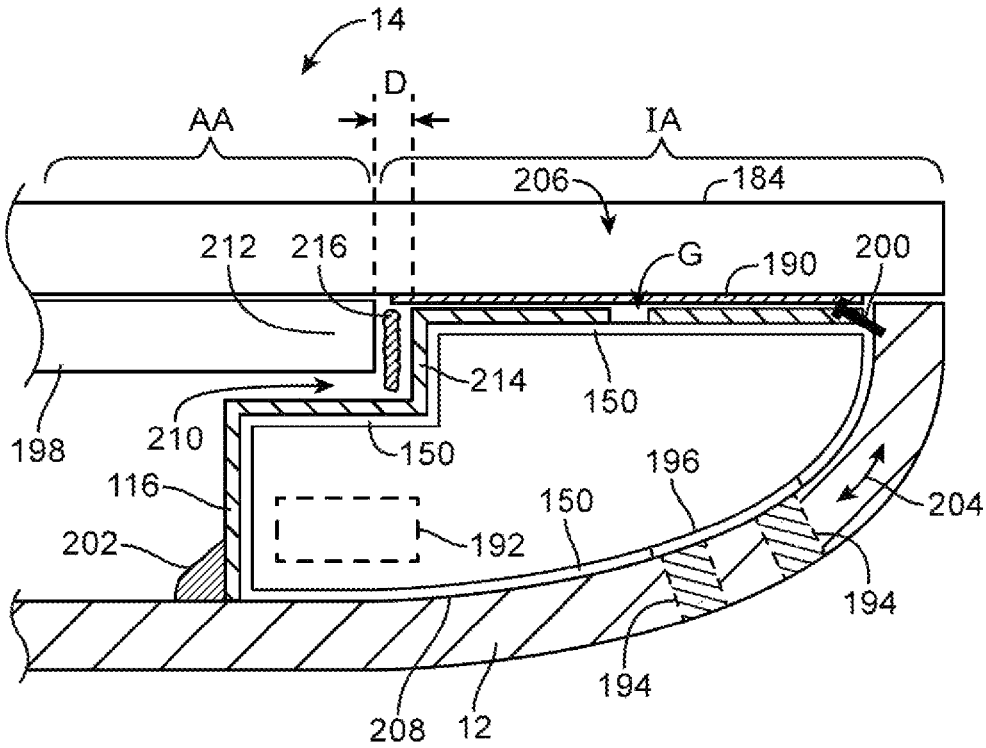
FIG. 13 is a cross-sectional side view of an illustrative antenna mounted within an electronic device housing in accordance with an embodiment of the present invention.

FIG. 13 is a cross-sectional side view of a portion of electronic device 10 showing how antenna structures 102 may be mounted along an edge of housing 12. As shown in FIG. 13, electronic device 10 may have a display such as display 14 that has an associated display module 198 and display cover layer 184. Display module 198 may be a liquid crystal display module, an organic light-emitting diode display, or other display for producing images for a user. Display cover layer 184 may be a clear sheet of glass, a transparent layer of plastic, or other transparent member. If desired, display cover layer 184 may form a portion of display module 198.

In active area AA, an array of display pixels associated with display structures such as display module 198 may present images to a user of device 10. In inactive display border region IA, the inner surface of display cover layer 184 may be coated with a layer of black ink or other opaque masking layer 190 to hide internal device structures from view by a user. Antenna structures 102 may be mounted within housing 12 under opaque masking layer 190. During operation, antenna signals may be transmitted and received through portion 206 of display cover layer 184 and, if desired, through dielectric portions of housing 12.

Housing 12 in the configuration of FIG. 13 has been formed from metal. Openings 194 in housing 12 may serve as speaker openings. Dielectric carrier 150 may be hollow and may contain components such as speaker driver 192. In this type of configuration, dielectric carrier 150 may serve as a speaker enclosure (speaker box) for speaker driver 192. Openings 196 in speaker enclosure 150 and openings 142 (FIG. 11) in loop antenna traces 116 (e.g., traces 116A) may be aligned with housing openings 194. During operation of speaker driver 192, sound may escape from the interior of speaker enclosure 150 through in enclosure 150, openings 142 in traces 116A, and openings 194 in housing wall 12. If desired, carrier 150 may be solid or may be a hollow structure that does not include a speaker driver.

As illustrated by curved portion 208 of carrier 150, antenna structures 102 may have a non-rectangular cross-sectional shape. Curved surface portion 208 may, for example, have a shape that matches the curved inner surface of housing wall 12.

The conductive structures that form antenna structures 102 such as the metal that forms loops L1 and L2 may be formed from conductive traces that are formed on the surface of carrier 150 and/or other conductive structures in device 10. As shown in FIG. 13, antenna currents 204 may, if desired, flow through conductive housing wall 12 in the portion of housing 12 that overlaps curved surface 208 of dielectric carrier 150. Other portions of dielectric carrier 150 may be covered with metal traces 116 (e.g., traces 116A and 116B of FIG. 11). Traces 114 of loop L1 (FIG. 11) may also be formed on carrier 150.

Conductive structures such as conductive structures 202 and 200 may be used to electrically couple traces 116 to metal housing 12 at either end of curved portion 208. When traces 116 are shorted to housing 12 in this way, loop antenna currents in loop L2 will pass through traces 116 on portions of carrier 150 other than curved surface 108 and will pass through housing 12 (as shown by currents 204) in the portions of housing 12 adjacent to curved surface 208 (i.e., the portion of housing 12 between conductive structure 200 and conductive structure 202). In the vicinity of curved surface 208 of carrier 150, the loop antenna currents in loop L2 will therefore pass through curved portions of housing 12 rather than through underlying antenna traces on carrier 150. Because housing 12 effectively forms part of antenna loop L2 in the vicinity of surface 208 in this type of configuration for antenna structures 102, conductive traces 116 can be omitted from surface 208 in the vicinity of surface 208 (i.e., surface 208 of carrier 150 may be free of metal traces).

Conductive structure 200 and 202 may include screws or other fasteners, welds, solder joints, conductive adhesive, connectors, conductive paint such as silver paint or other metal paint, other conductive structures, or combinations of these structures. As an example, structures 200 may include one or more screws and structures 202 may include metal tape.

As shown in FIG. 13, carrier 150 may be provided with a recess such as recess 210 to accommodate end portion 212 of display module 198. If desired, antenna structures 102 may have other shapes to accommodate other electrical or mechanical components in interior portions of device 10.

Gaps such as gap G of FIG. 13 (e.g., gaps G1 and/or G2 of FIG. 11) may be formed on the upper surface of carrier 150. During operation, antenna signals may tend to be concentrated around the upper surface of carrier 150. Because fewer signals are associated with other portions of carrier 150, relatively small gaps may be used so separate traces 116 on other portions of carrier 150 from surrounding conductive structures. For example, a gap D of about 0.5 mm to 1.5 mm or less may be used to separate metal trace portion 116' from display module portion 212 of display module 198. Insulating (dielectric) material such as material 216 may be used to help electrically isolate antenna traces 116 from display module 198. Material 216 may be, for example, insulating foam that is attached to traces 116 and/or display module 198 using adhesive.

The foregoing is merely illustrative of the principles of this invention and various modifications can be made by those skilled in the art without departing from the scope and spirit of the invention.

What is claimed is:

1. An antenna, comprising:

a dielectric carrier having a longitudinal axis; and a loop antenna resonating element that extends around the longitudinal axis and surrounds at least part of the dielectric carrier, wherein the loop antenna resonating element includes at least first and second parallel subloops, wherein the first subloop includes metal traces on the dielectric carrier, the metal traces are configured to form a plurality of parallel openings, metal segment structures are formed between the parallel openings, and the metal segment structures collectively produce an inductance in the first subloop.

2. The antenna defined in claim 1 wherein the first subloop includes a first strip of conductive structures wrapped around the longitudinal axis and wherein the second subloop includes a second strip of conductive structures wrapped around the longitudinal axis.

3. The antenna defined in claim 2 wherein the first strip of conductive structures includes the metal traces on the dielectric carrier.

4. The antenna defined in claim 3 wherein the first strip of conductive structures includes a gap that produces a capacitance in the first subloop.

5. The antenna defined in claim 4 wherein at least part of the first strip of conductive structures is separated from at least part of the second strip of conductive structures by an opening in the loop antenna resonating element.

6. The antenna defined in claim 1 wherein the dielectric carrier has a hollow interior and wherein the antenna further comprises a speaker driver in the hollow interior.

7. The antenna defined in claim 1 wherein the dielectric carrier has a recess configured to receive a portion of a display module.

8. The antenna defined in claim 1 wherein the dielectric carrier has a curved portion without antenna traces that is configured to run parallel to a curved portion of a metal electronic device housing wall that forms at least part of the loop antenna resonating element.

9. An antenna, comprising:

a dielectric carrier having a longitudinal axis; and a loop antenna resonating element that extends around the longitudinal axis and surrounds at least part of the dielectric carrier, wherein the loop antenna resonating element includes at least first and second parallel subloops, wherein the antenna loop resonating element comprises metal traces on the dielectric carrier and wherein an opening in the metal traces separates at least part of the first subloop from at least part of the second subloop.

10. The antenna defined in claim 9 further comprising an indirect feeding loop antenna element formed from metal on the dielectric carrier.

11. The antenna defined in claim 10 wherein the indirect feeding loop antenna element has positive and ground antenna feed terminals and wherein at least the first subloop includes a gap that produces a capacitance for the first subloop.

12. The antenna defined in claim 11 wherein the first subloop includes a plurality of parallel metal segments that collectively provide the first subloop with an inductance.

13. A distributed loop antenna, comprising:

an antenna feed; and an antenna resonating element formed from first and second antenna resonating element loops that run parallel to each other around an axis, wherein the antenna resonating element includes metal traces on a dielectric carrier and includes portions of a metal electronic device housing wall.

14. The antenna defined in claim 13 further comprising a screw for attaching the metal traces to the metal electronic device housing wall.

15. The distributed loop antenna defined in claim 13 wherein the first antenna resonating element loop includes a capacitance and an inductance.

16. The distributed loop antenna defined in claim 15 wherein the second antenna resonating element loop includes a capacitance.

17. The distributed loop antenna defined in claim 15 further comprising an elongated dielectric carrier that extends along the axis, wherein the first antenna resonating element loop includes metal traces on the elongated dielectric carrier that extend in a strip around the axis.

18. The distributed loop antenna defined in claim 13 wherein the first antenna resonating element loop is characterized by an antenna resonance at a first operating frequency and wherein the second antenna resonating element loop is characterized by an antenna resonance at a second operating frequency that is different than the first operating frequency.

19. Apparatus, comprising:

an electronic device housing having an edge;

an elongated dielectric carrier that extends along a longitudinal axis parallel to the edge; and metal structures on the elongated dielectric carrier that form a distributed loop antenna having a loop antenna resonating element that has a width and that extends around the longitudinal axis, wherein the loop antenna resonating element includes first and second parallel subloops, wherein the metal structures include metal traces on the dielectric carrier and wherein the metal traces include a slot that separates at least part of the first subloop from at least part of the second subloop.

20. The apparatus defined in claim 19 wherein the metal structures includes parallel elongated openings that form segments of metal that collectively produce an inductance for the first subloop.

21. The apparatus defined in claim 20 wherein the first subloop includes a capacitance formed from a gap in the metal traces.

* * * * *